US005924360A

United States Patent [19]

Adachi et al.

[11] Patent Number: 5,924,360

[45] Date of Patent: Jul. 20, 1999

[54] SMOOTH STENCIL BASE SHEET, METHOD OF PRODUCING A PRINTING MASTER FROM THE STENCIL BASE SHEET AND METHOD OF PERFORMING STENCIL PRINTING

[75] Inventors: Hiroshi Adachi, Numazu; Kouichi Ohshima, Mishima; Masanori Rimoto, Mishima; Fumiaki Arai, Mishima; Hiroshi Tateishi, Fujinomiya; Tetsuo Tanaka, Mishima, all of Japan

[73] Assignees: Ricoh Company, Ltd., Tokyo; Tohoku Ricoh Co., Ltd., Miyagi-ken, both of Japan

[21] Appl. No.: 08/867,477

[22] Filed: Jun. 2, 1997

[30] Foreign Application Priority Data

Jun. 3, 1996 [JP] Japan ..... 8-162312

[51] Int. Cl.[6] ..... B41N 1/24

[52] U.S. Cl. ..... 101/128.21; 101/116; 101/129

[58] Field of Search ..... 101/115, 116, 101/127, 128.21, 128.4, 129

*Primary Examiner*—Stephen R. Funk

*Attorney, Agent, or Firm*—Cooper & Dunham LLP

[57] ABSTRACT

A stencil base sheet includes a thermoplastic resin film, with a surface of the stencil base sheet on the side of the thermoplastic resin film having a surface smoothness of at least 6000 seconds. From this stencil base sheet, a printing master is prepared by use of a heat-emitting resistor with the application of electric signals thereto with pulse modulation corresponding to image recording density, thereby forming perforations of a different size corresponding to recording image density in the stencil base sheet by thermal fusing. Furthermore, a monochrome or multi-color stencil printing is performed by using the printing master.

14 Claims, 10 Drawing Sheets

PENETRATION OF INK

PENETRATION OF INK

PENETRATION OF INK

SMOOTH STENCIL BASE SHEET, METHOD OF PRODUCING A PRINTING MASTER FROM THE STENCIL BASE SHEET AND METHOD OF PERFORMING STENCIL PRINTING

BACKGROUND OF THE INVENTION

1. Field of the Invention

The present invention relates to a stencil base sheet, a method of producing a printing master from the stencil base sheet, and a method of performing monochrome or multicolor stencil printing, using the above-mentioned stencil base sheet.

2. Discussion of Background

Conventionally, when a printing master is made from a thermosensitive stencil bass sheet, thermal energy is applied to the stencil base sheet through a thermal head. In this case, pulse signals with a predetermined electric power and voltage are applied to the thermal head to form perforations in the stencil base sheet. Therefore, images obtained on an image receiving sheet using the printing master are printed in dots of the same size.

When a photographic image with a halftone is printed using such a thermosensitive stencil base sheet, if the perforation is performed in the stencil base sheet with the application of thermal energy based on a binary system, using a predetermined threshold of the optical density for the image, an image with an extremely high contrast can be obtained, but without the halftone, so that when such a photographic image is printed, a technique of exhibiting the halftone with the density of dots, for example, an error diffusion process represented by a dither method, is conventionally used. Such technique can improve the gradation of the image much better than the above-mentioned method using the binary system can. However, the above-mentioned technique is not always satisfactory due to the formation of some graininess in highlight portions, and insufficient resolving power for thin lines.

In order to solve the above-mentioned problems, Japanese Laid-Open Patent Application 08-90748 proposes that the energy to be applied to the thermal head be controlled by a pulse width or an applied voltage which is adjusted so as to be proportional to the image density, thereby obtaining perforations of different sizes corresponding to Image densities. This method can improve the quality of halftone images much more than the above-mentioned method using the binary system, but is not yet satisfactory since small perforations cannot be accurately formed, and that some graininess is still observed, in particular, in highlight portions.

To be more specific, even when the stencil base sheet is prepared by gluing a thermoplastic resin film to a porous support, if the thermoplastic resin film cannot compensate for the roughness of the porous support, the roughness of the porous support evidently appears at the surface of the thermoplastic resin film, and the surface smoothness of the thermoplastic resin film is lowered. If this takes place, a heat-emitting resistor element such as a thermal head cannot sufficiently come into close contact with some portions of the stencil base sheet. In such portions, heat transfer from the heat-emitting resistor element to the stencil base paper is insufficient, so that perforations cannot be accurately formed in the portions. If the diameter of each perforation differs depending upon the state of the contact of the heat-emitting resistor element with the stencil base paper, even though the energy applied to the heat-emitting resistor element is accurately controlled so as to have a pulse width or a voltage in proportion to the image recording density, it is impossible to control the size of each perforation according to the applied energy. As a result, dots with a predetermined area cannot always be accurately formed. In particular, at highlight portions, it is required that small perforations be accurately formed with the application of a small amount of thermal energy thereto. Therefore, when the heat-emitting resistor element is not in close contact with the stencil base sheet, a number of imperfect or inappropriate perforations will be formed, so that there may occur a problem that no dots are formed in the portions whore there should be formed dots, that is, the so-called "dots omission" problem takes place. The result is that the graininess of the highlight portions is increased and the image quality is significantly lowered.

Japanese Laid-Open Patent Application 5-212983 discloses a stencil base paper comprising a thermoplastic resin film with a smoothness of 1000 seconds or more, which is prepared in order to improve image quality, perforation sensitivity and transportation performance of the stencil base paper.

Japanese Laid-Open Patent Application 8-67081 also discloses a stencil base sheet comprising a thermoplastic resin film which has a maximum surface roughness of 10 $\mu$m or less and a surface smoothness of 1000 seconds or more in order to improve the image quality and perforation sensitivity.

These stencil base sheets, however, are not satisfactory, either for the formation of perforations by the image formation based on the above-mentioned binary system without pulse modulation due to the formation of the graininess in highlight portions, or for the formation of perforations by a multi-valued dot image formation with pulse modulation, using a thermal head.

Furthermore, when a uniform solid image is formed on an image receiving sheet using the stencil base sheet, there may occur a so-called "offset" that an unfixed toner which stays on a previously discharged image receiving sheet without being absorbed by the image receiving sheet comes in contact with the back side of the next discharged image receiving sheet and the back side of the image receiving sheet is stained with the unfixed ink. This problem is caused by the ink being transferred to the solid image portion of the image receiving sheet in an amount more than the amount that can be absorbed by the solid image portion.

In order to prevent the occurrence of the above-mentioned "offset", the following methods are disclosed:

In Japanese Laid-Open Patent Application 1-267094, there is disclosed a thermosensitive stencil base paper comprising a support which is composed of at least two paper layers with different densities made of tissue papers.

In Japanese Laid-open Patent Application 4-265783, there is proposed a method for producing a printing master from a stencil paper in such a manner that the peripheral portion of each perforation made in the printing master protrudes from the other portions of the printing master.

Furthermore, in Japanese Laid-Open Patent Application 8-197825, there is disclosed a stencil master comprising a porous sheet having such ink penetration routes that hinder direct flow of the ink to prevent the occurrence of the offset. However, the "offset" problem is not completely solved by the above-mentioned methods.

Japanese Laid-Open Patent Application 2-16053 discloses a stencil printing method in which an excessive ink is removed from printed materials by use of an excess-ink-transfer sheet.

Japanese Laid-Open Patent Application 8-239613 discloses an emulsion ink for stencil printing, which comprises a compound whose phase is changed to a liquid at a temperature in the range of 30 to 100° C. in an oil phase of the emulsion ink.

By the above-mentioned methods and the ink, the "offset" problem can be solved to some extent, but cannot be completely solved. Furthermore, the above-methods have a shortcoming that special apparatus is required.

SUMMARY OF THE INVENTION

It is therefore a first object of the present invention to provide a stencil base sheet for preparing a printing master therefrom by use of a heat-emitting resistor element such as a thermal head, which stencil base sheet is capable of forming multi-valued dots with excellent reproduction performance and high perforation sensitivity and capable of producing images with high gradation and high resolution, and is free from the off-set problem.

A second object of the present invention is to provide a method of producing from the above-mentioned stencil base sheet a printing master which is capable of producing images with high gradation and high resolution, and is free from the off-set problem.

A third object of the present invention is to provide a method of performing monochrome stencil printing, using the above-mentioned stencil base sheet, which method is capable of providing stencil printed images with high gradation and high resolution, without the "offset" problem.

A fourth object of the present invention is to provide a method of performing multi-color stencil printing, using the above-mentioned stencil base sheet, which method is capable of providing stencil printed images with high gradation and high resolution, without the "offset" problem.

The above-mentioned first object of the present invention can be achieved by a stencil base sheet comprising a thermoplastic resin film, with a surface of the stencil base sheet on the side of the thermoplastic resin film having a surface smoothness of at least 6000 seconds. From this stencil base sheet, a printing master can be prepared by use of a heat-emitting resistor element with the application of electric signals thereto with pulse modulation corresponding to the image recording density to be obtained, thereby forming perforations of a different size in the stencil base sheet by thermal fusing, corresponding to the recording image density.

In the above stencil base sheet, it is preferable that the thermoplastic resin film be a biaxially oriented film.

Furthermore, the above stencil base sheet may further comprise a porous support with which the thermoplastic resin film is backed, and the porous support may be a porous resin film.

The second object of the present invention can be achieved by a method of producing a printing master from the above-mentioned stencil base sheet, comprising the step of forming perforations of a different size in the stencil base sheet by thermal fusing, corresponding to the image recording density to be obtained, by use of a heat-emitting resistor element with the application of electric signals thereto with pulse modulation corresponding to said image recording density.

The third object of the present invention can be achieved by a method of performing stencil printing, using the above-mentioned stencil base sheet, comprising the steps of:

forming perforation images comprising perforations of a different size in the stencil base sheet by thermal fusing, corresponding to the recording image density to be obtained, by use of a heat-emitting resistor element with the application of electric signals thereto with pulse modulation corresponding to the image recording density, thereby preparing a printing matter with the perforation images, winding the printing master around an outer surface of a printing cylinder capable of supplying an ink from the inner surface thereof to the printing master, bringing an image receiving sheet into pressure contact with the printing master, and transferring the ink perforated imagewise to the image receiving sheet to form perforation images thereon.

The fourth object of the present invention can be achieved by a method of performing multi-color stencil printing, using a stencil base sheet comprising a thermoplastic film, with a surface of the stencil base sheet on the side of the thermoplastic film having a smoothness of at least 6000 seconds for each color, comprising the steps of:

forming perforation images comprising perforations of a different size in the stencil base sheet by thermal fusing, corresponding to the recording image density to be obtained, by use of a heat-emitting resistor element with the application of electric signals thereto with pulse modulation corresponding to the image recording density, thereby preparing a color printing master for each color with the perforation images, winding each of the color printing masters around an outer surface of each color printing cylinder capable of supplying a color ink from the inner surface thereof to each of the printing masters, bringing an image receiving sheet into pressure contact with each of the color printing masters successively, and transferring each of the inks perforation-imagewise to the image receiving sheet successively to form multi-color perforation images thereon.

In the above method, there may be provided four color printing cylinders, each using one of cyan, yellow, magenta and black inks as the color ink.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 5(*b*) is a graph showing how the pulse amplitude is changed by the input signals shown in FIG. 5(*a*).

FIG. 5(*c*) is a circuit diagram for the pulse amplitude modulation.

FIG. 6(*b*) is a graph showing how the pulse width is changed by the input signals shown in FIG. 6(*a*) in proportion with respective sampled values.

FIG. 6(*c*) is a block diagram for the pulse width modulation.

DESCRIPTION OF THE PREFERRED EMBODIMENTS

The stencil base sheet of the present invention comprises a thermoplastic resin film, with a surface of the stencil base sheet on the side of the thermoplastic resin film having a surface smoothness of at least 6000 seconds, preferably 8000 seconds or more.

When a printing master is prepared from this stencil base sheet, perforations of a different size, corresponding to the recording image density to be obtained are formed in the stencil base sheet by thermal fusing, using a heat-emitting resistor with electric signals being applied thereto with pulse modulation corresponding to the image recording density. The pulse modulation can be carried out, for example, by changing pulse width (that is, by changing the supplied quantity of electricity with current and/or application time being changed, by changing pulse height (that is, by changing applied voltage), or by changing both the pulse width and the pulse height in combination.

Figure 3:
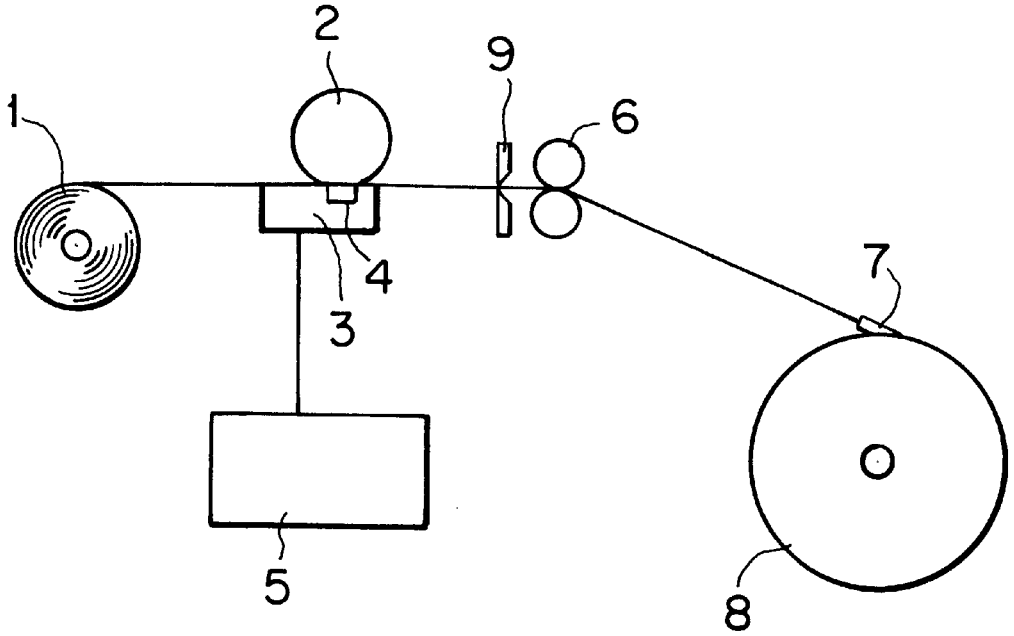
FIG. 3 is a schematic diagram of an apparatus for making a printing master from the stencil base sheet according to the present invention.

FIG. 3 is a schematic diagram of an apparatus for making a printing master from the stencil base sheet according to the present invention.

In FIG. 3, reference numeral 1 indicates a stencil base sheet of the present invention; reference numeral 2, a platen roller; reference numeral 3, a thermal head; reference numeral 4, a heat-emitting resistor device including heating elements; reference numeral 5, a pulse modulation control unit; reference numeral 6, a pair of printing master transporting rollers; reference numeral 7, a printing master holding means; reference numeral 8, a printing cylinder; and reference numeral 9, stencil base sheet cutting means.

According to the present invention, perforations of different sizes (or with different areas) are formed in the stencil base sheet, so that dots with different areas can be formed on an image receiving sheet. Thus, the area of the dot can be expressed by multi-values. It is preferable that the kinds of the area of the dot, including a zero area, be 3 or more, more preferably 4 or more.

Figure 4:
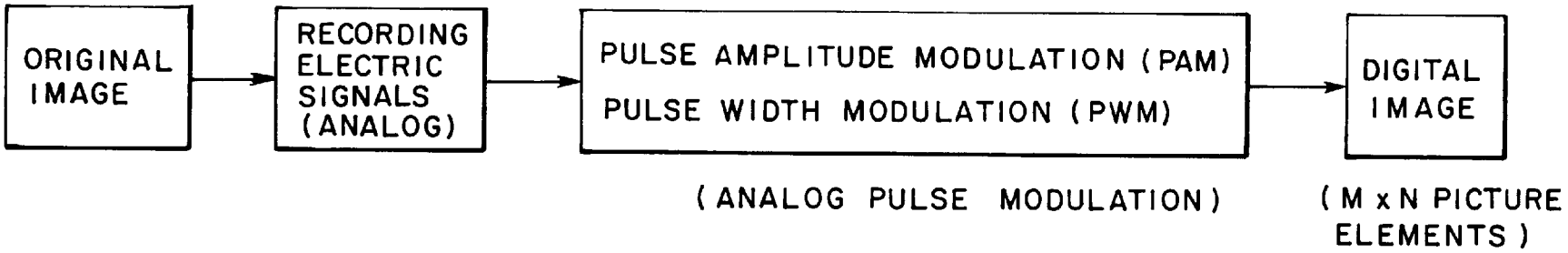
FIG. 4 is a flow chart for conversion of an original image into a digital image by analog pulse modulation.

FIG. 4 is a flow chart showing an example of the pulse modulation method that can be employed in the present invention. As shown in FIG. 4, an original image is read and analog recording electric signals which correspond to the original image are subjected to analog pulse modulation (pulse amplitude modulation or pulse width modulation), with the parameter of the pulse waveform being continuously changed based on a sampled value, whereby the original image is converted into a digital image (M×N picture elements). Perforations are formed in the stencil base sheet in accordance with the output signals of the digital image thus converted.

Figure 5A:
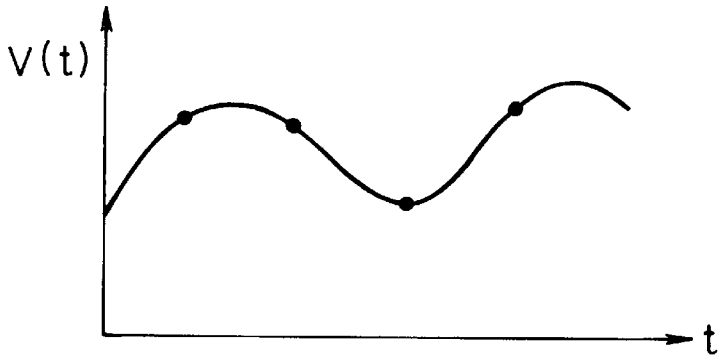
FIG. 5(*a*) is a graph showing input signals in a pulse amplitude modulation.
Figure 5B:
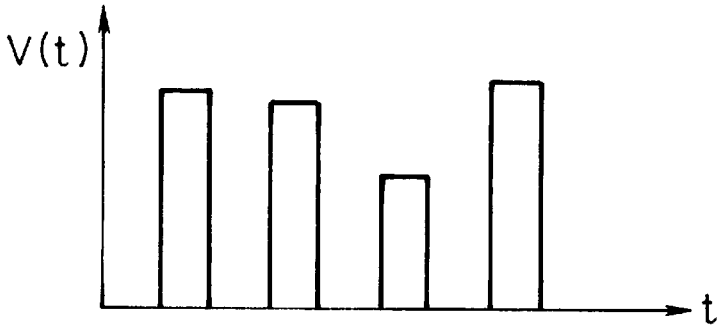
Figure 5C:
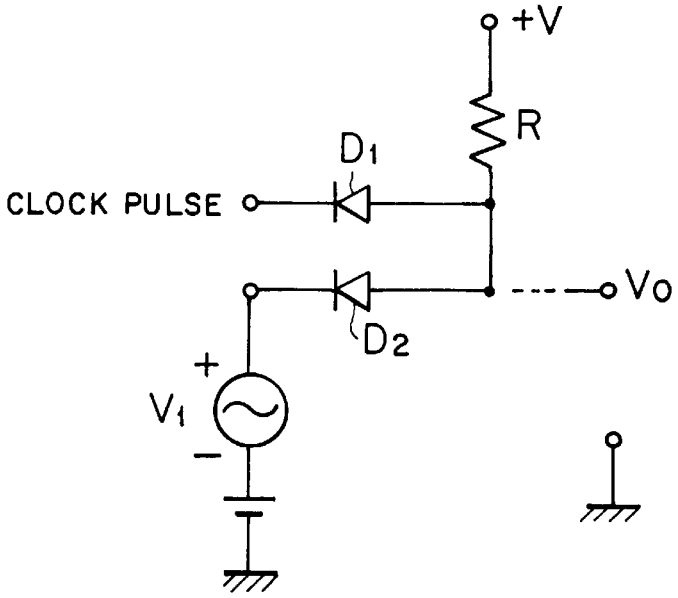

FIG. 5(*a*) is a graph showing input signals in a pulse amplitude modulation.

FIG. 5(*b*) is a graph showing how the pulse amplitude is changed by the input signals shown in FIG. 5(*a*). More specifically, the amplitude at the parameter of the pulse wave sampled by clock pulses is changed by the input signals.

FIG. 5(*c*) is a circuit diagram for the pulse amplitude modulation.

Thus, a voltage corresponding to the original image is applied to a heat-emitting resistor element of a thermal head.

Figure 6A:
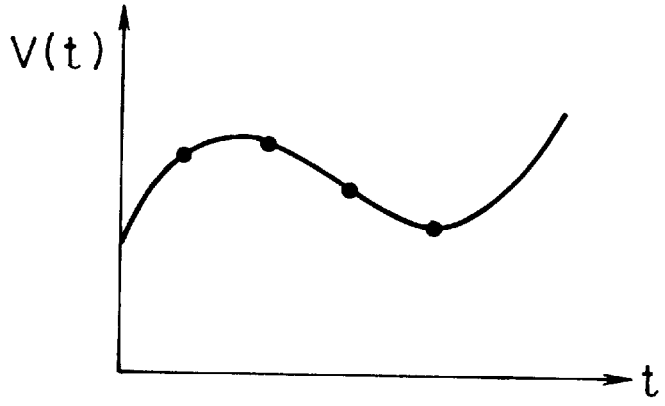
FIG. 6(*a*) is a graph showing input signals in a pulse width modulation.
Figure 6B:
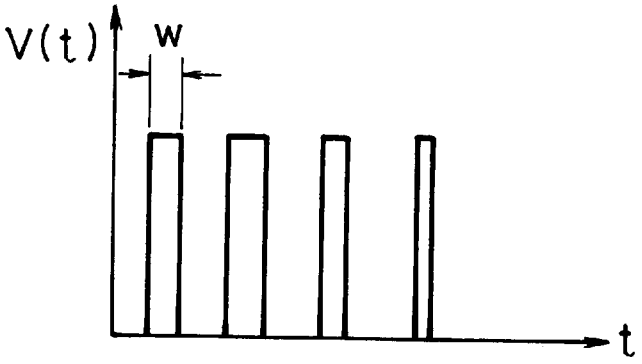
Figure 6C:
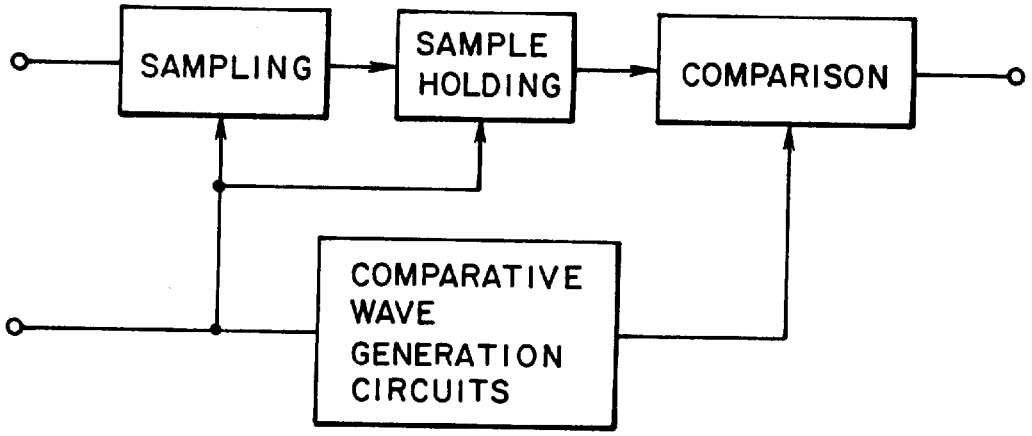

FIG. 6(*a*) is a graph showing input signals in a pulse width modulation.

FIG. 6(*b*) is a graph showing how the pulse width is changed by the input signals shown in FIG. 6(*a*) in proportion with the respective sampled values.

FIG. 6(*c*) is a block diagram for the pulse width modulation.

Thus, a quantity of electricity corresponding to the original image is supplied to the heat-emitting resistor element of a thermal head.

According to the present invention, the surface of the stencil base sheet on the side of the thermplastic resin film has a surface smoothness of at least 6000 seconds. This surface smoothness is measured by Okenshiki air permeability and smoothness tester.

When the surface smoothness of the surface of the stencil base sheet on the side of the thermoplastic resin film is 6000 seconds or more, the close contact of the heat-emitting resistor element with the surface of the stencil base paper is so improved that the perforation of a size corresponding to the amount of the applied thermal energy can be accurately formed in the stencil base paper. As a result, dots with multi-valued areas can be formed as desired, so that full-color images with high image quality, which require high gradation and high resolution, can be obtained, in particular, in printed matters including photographic images. In particular, small dots can be uniformly formed on the image receiving sheet, so that a highlight portion free of graininess can be obtained.

Furthermore, when a solid image is printed on the image receiving sheet, since perforations of uniform size can be accurately formed in the stencil base sheet, the amount of the ink necessary for the formation of the solid image on the image receiving sheet can be minimized to an amount which is below the amount of the ink that can be absorbed by the image receiving sheet. As a result, the occurrence of the "offset" can be avoided.

The above-mentioned solid image formation free of the "offset" will now be explained more specifically with reference to FIGS. 14(*a*) and 14(*b*), which are schematic cross-sectional views in explanation of the printing of a solid image on an image receiving sheet by use of the printing master prepared from the stencil base sheet according to the present invention.

Figure 14A:
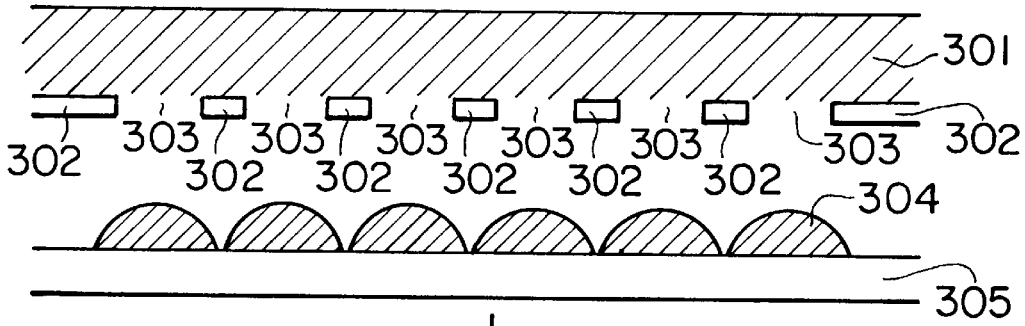
FIGS. 14(*a*) and 14(*b*) are schematic cross-sectional views in explanation of the printing of a solid image on an image receiving sheet by use of the printing master prepared from the stencil base sheet according to the present invention.
Figure 14B:
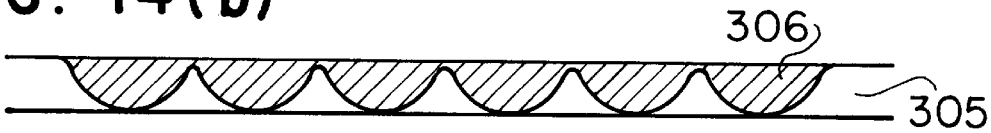

In FIG. 14(*a*), reference numeral 302 indicates non-perforated portions of the printing master; and reference numeral 303 indicates perforations normally made in the printing master. An ink held in an ink-holding portion 301 is caused to pass through the perforations 303 of the printing master, and transferred onto an image receiving sheet 305. Reference numeral 304 indicates the ink which has been transferred to the surface of the image receiving sheet 305 and deposited thereon, without penetrating the image receiving sheet 305.

The ink then penetrates into the image receiving sheet 305, so that a solid image is formed by an ink 306 which penetrates into the image receiving sheet 305 as shown in FIG. 14(*b*).

When the surface smoothness of the surface of the stencil base sheet on the side of the thermoplastic resin film is less than 6000 seconds, the contact of the heat-emitting resistor element with the surface of the stencil base paper is inferior to the case where the surface smoothness of the surface of the stencil base sheet on the side of the thermoplastic resin film is 6000 seconds or more, so that there are formed portions where the heat-emitting resistor element is not in close contact with the surface of the stencil base paper. In such portions, perforation cannot be performed either accurately or completely. The result is that dots with the desired areas cannot be obtained, or no dots are formed, or the gradation and resolution are significantly lowered.

However, when the energy applied to the heat-emitting resistor element is increased so as to make normal perforations in the portions where the heat-emitting resistor element is not in close contact with the surface of the stencil base paper, normal perforations may be formed in such portions. However, in the portions where the heat-emitting resistor element is in close contact with the surface of the stencil base paper, perforations with areas larger than required or desired are formed. The result is that perforations of non-uniform size are formed.

Furthermore, when the solid image is formed, if the size of the perforations is smaller than a predetermined size, a sufficient amount of the ink is not transferred to the image receiving sheet, so that "non-printed spots" are formed in the solid image.

The above-mentioned solid image formation, in which the "non-printed spots" may be formed, will now be explained more specifically with reference to FIGS. 15(*a*) and 15(*b*), which are schematic cross-sectional views in explanation of the printing of the solid image on the image receiving sheet by use of a printing master prepared from a comparative stencil base sheet.

Figure 15A:
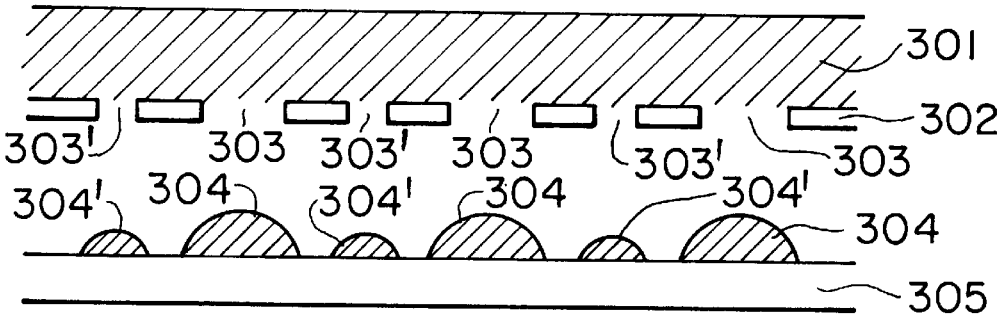
FIGS. 15(*a*) and 15(*b*) are schematic cross-sectional views in explanation of the printing of the solid image on the image receiving sheet by use of a printing master prepared from a comparative stencil base sheet, in which printing "non-printed spots" are formed in the solid image.
Figure 15B:
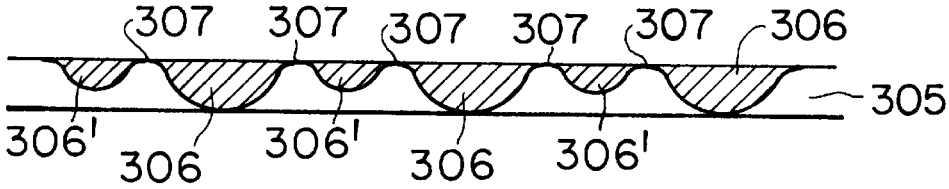

In FIG. 15(*a*), reference numeral 302 indicates non-perforated portions of the printing master; reference numeral 303 indicates perforations normally made in the printing master; and reference numeral 303' indicates perforations which are smaller than the normally made perforations 303. The ink held in the ink-holding portion 301 is caused to pass through the perforations 303 and 303' of the printing master, and transferred onto the image receiving sheet 305. Reference numeral 304 indicates the ink which has been transferred through the normally made perforations 303 to the surface of the image receiving sheet 305 and deposited thereon, without penetrating the image receiving sheet 305; and reference numeral 304' indicates the ink which has been transferred through the smaller perforations 303' to the surface of the image receiving sheet 305 and deposited thereon, without penetrating the Image receiving sheet 305.

The ink then penetrates into the image receiving sheet 305, as shown in FIG. 15(*b*). However, a complete solid image is not formed by an ink 306 and an ink 306' which penetrate into the image receiving sheet 305, and an image with non-printed spots 307 is formed as shown in FIG. 15(*b*).

A solid image free of the above-mentioned white non-printed spots may be obtained by causing a sufficient amount of the ink to pass even through the perforations 303' to avoid the formation of the "non-printed spots", with the application of an increased printing pressure thereto. In this case, however, as shown in FIGS. 16(*a*) and 16(*b*), the ink is transported and deposited on the image receiving sheet in such an amount that the image receiving sheet cannot absorb the ink, so that the so-called "offset" problem is caused.

Figure 16A:
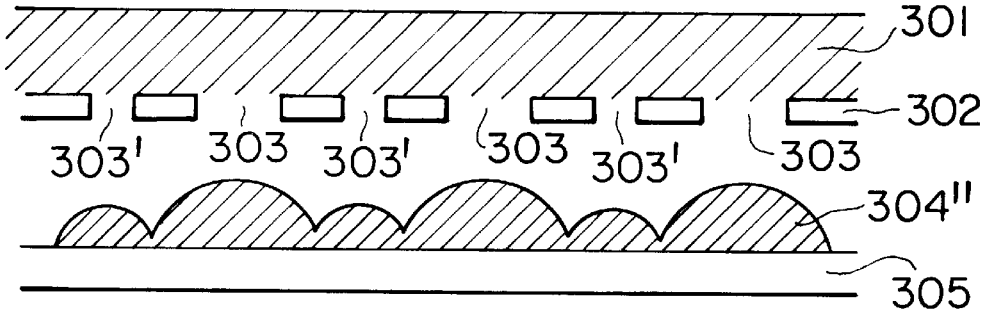
FIGS. 16(*a*) and 16(*b*) are schematic cross-sectional views in explanation of the printing of the solid image on the image receiving sheet by use of a printing master prepared from a comparative stencil base sheet, in which printing "offset" takes place.
Figure 16B:
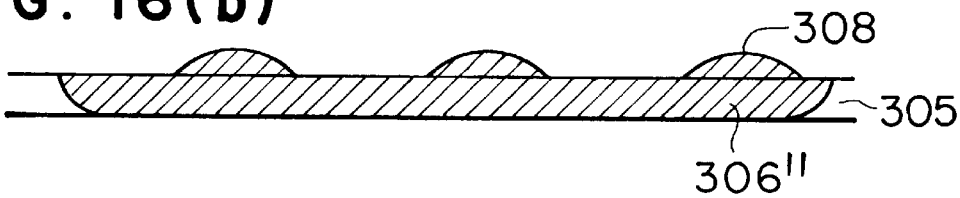

More specifically, in FIG. 16(*a*), reference numeral 302 indicates non-perforated portions of the comparative printing master; reference numeral 303 indicates perforations normally made in the printing master; and reference numeral 303' indicates perforations which are smaller than the normally made perforations 303. The ink held in the ink-holding portion 301 is caused to pass through the perforations 303 and 303' of the printing master, and transferred onto the image receiving sheet 305, with the application of an increased printing pressure thereto. Reference numeral 304" indicates the ink which has been transferred through the normally made perforations 303 to the surface of the image receiving sheet 305 and deposited thereon, without penetrating the image receiving sheet 305; reference numeral 306" indicates the ink which has been caused to penetrate into the image receiving sheet 305; and reference numeral 308 indicates an ink which remains unfixed on the image receiving sheet 305, without penetrating into the image receiving sheet 305. The unfixed ink 308 which remains on the image receiving sheet 305 causes the so-called "offset" problem.

The stencil base sheet according to the present invention comprises a thermoplastic resin film. For easy handling or winding the stencil base sheet around a printing cylinder, it is preferable that the thermoplastic resin film be backed with a porous resin film, a porous tissue-paper or a screen mesh.

For instance, a thermoplastic resin film may be glued to a porous resin film which is manufactured by a method as disclosed in Japanese Patent Application 7-334373. As the porous tissue-paper, there can be employed paper made from hemp fibers, synthetic fibers, wood fibers, or a mixture of those fibers, and a thermoplastic resin film may be glued to such a porous tissue-paper to prepare a stencil base sheet of the present invention.

The stencil base sheet according to the present invention may further comprise a sticking-preventing layer which is overlaid on the thermoplastic resin film.

The thermoplastic resin film for use in the present invention may be thermoplastic resin films in general use, which can be produced by conventional methods, such as extrusion or flow casting.

It is preferable that the thermoplastic resin film for use in the present invention be a biaxially oriented film.

Specific examples of the thermoplastic resin for use in the thermoplastic resin film are polyethylene resins such as polyethylene, ethylene—vinyl acetate copolymer, and ethylene—vinyl alcohol copolymer; polypropylene resins, polyester copolymers such as polyethylene terephthalate and polybutylone terephthalate; polyamide resins; styrene resins; acrylic acid derivative based resins; acrylonitrile resins; and polycarbonate resins.

It is also preferable that the thermoplastic resin film for use in the present invention have high perforation sensitivity. One of the important factors which determine the perforation sensitivity is the degree of crystallinity of the thermoplastic resin film. It is preferable that the degree of crystallinity of the thermoplastic resin film be in the range of an amorphous state to 20%. It is more preferable that the thermoplastic resin film be in an amorphous state.

It is preferable that the thickness of the thermoplastic resin film be in the range of 0.1 to 30 $\mu$m, more preferably in the range of 0.3 to 10 $\mu$m, in order to form perforations for use in the present invention.

In addition, it is preferable that the melting point of the thermoplastic resin film be in the range of 50 to 300° C., more preferably in the range of 70 to 290° C. When the melting point of the thermoplastic resin film is within the above-mentioned range, the formation of the film is easy, and the preservation stability of the stencil base sheet is appropriate. In addition to the above, perforations can be formed in the stencil base sheet without difficulty. In light of the above-mentioned points, it is preferable that the thermoplastic resin film comprise a polyester copolymer, in particular, polyethylene phthalate.

Figure 1:
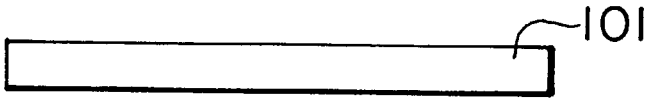
FIG. 1 is a cross-sectional view of one example of a thermosensitive stencil base sheet according to the present invention.

FIG. 1 is a schematic cross-sectional view of an example of a stencil base sheet of the present invention. In FIG. 1, reference numeral 101 indicates a thermoplastic film.

Figure 2:
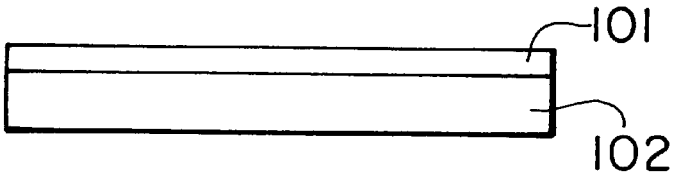
FIG. 2 is a cross-sectional view of another example of a thermosensitive stencil base sheet according to the present invention.

FIG. 2 is a schematic cross-sectional view of another example of a stencil base sheet of the present invention. In FIG. 2, reference numeral 101 indicates a thermoplastic film, and reference 102 indicates a porous support.

As previously mentioned, there is provided a method of producing a printing master from the above-mentioned stencil base sheet comprising a thermoplastic film with a surface smoothness of at least 6000 seconds. The above-mentioned method comprises the step of forming perforations of different sizes in the stencil base sheet by thermal fusing corresponding to image density by use of a heat-emitting resistor element with the application of electric signals thereto with pulse modulation corresponding to image recording density.

Further, by using a stencil printing apparatus with the printing master prepared from the above-mentioned stencil base sheet being incorporated therein, high quality monochrome images with excellent gradation and resolution can be printed on an image receiving sheet.

Figure 7:
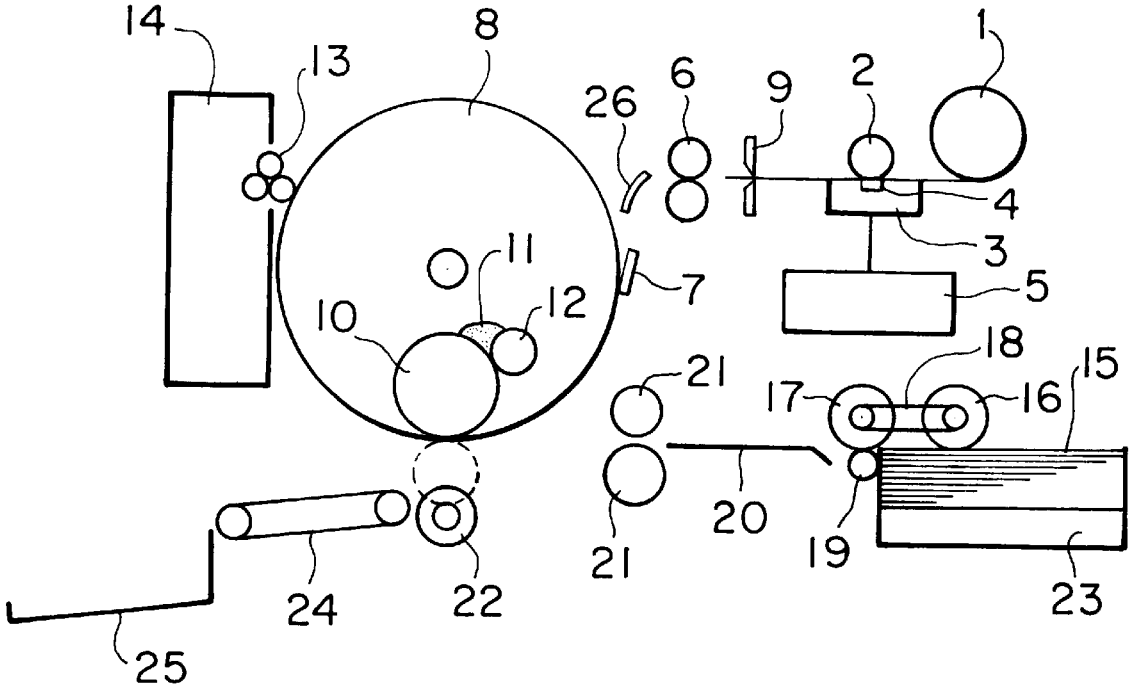
FIG. 7 is a schematic diagram of an example of the stencil printing apparatus using a monochrome printing master prepared from the stencil base sheet according to the present invention.

FIG. 7 is a schematic diagram of an example of the stencil printing apparatus using a monochrome printing master prepared from the stencil base sheet according to the present invention.

In FIG. 7, reference numeral 1 indicates a thermosensitive stencil base sheet according to the present invention; reference numeral 2, a platen roller; reference numeral 3, a thermal head; reference numeral 4, a heat-emitting resistor element; reference numeral 5, a pulse modulation control unit; reference numeral 6, a pair of transport rollers; reference numeral 7, a printing master holding means; reference numeral 8, a printing cylinder; reference numeral 9, a stencil base sheet cutting means; reference numeral 10, an ink roller; reference numeral 11, an ink held; reference numeral 12, a doctor roller; reference numeral 13, a printing master discharge roller; reference numeral 14, a printing master discharge box; reference numeral 15, printing paper serving as an image receiving sheet; reference numeral 16, a paper pick-up roller; reference numeral 17, a separation roller; reference numeral 16, a gear belt; reference numeral 19, a separation roller; reference numeral 20, a printing paper guide plate; reference numeral 21, a pair of resist rollers; reference numeral 22, a press roller; reference numeral 23, a paper feed tray; reference numeral 24, a printing paper transport belt; reference numeral 25, a paper discharge tray; and reference numeral 26, a printing master guide plate.

Figure 8:
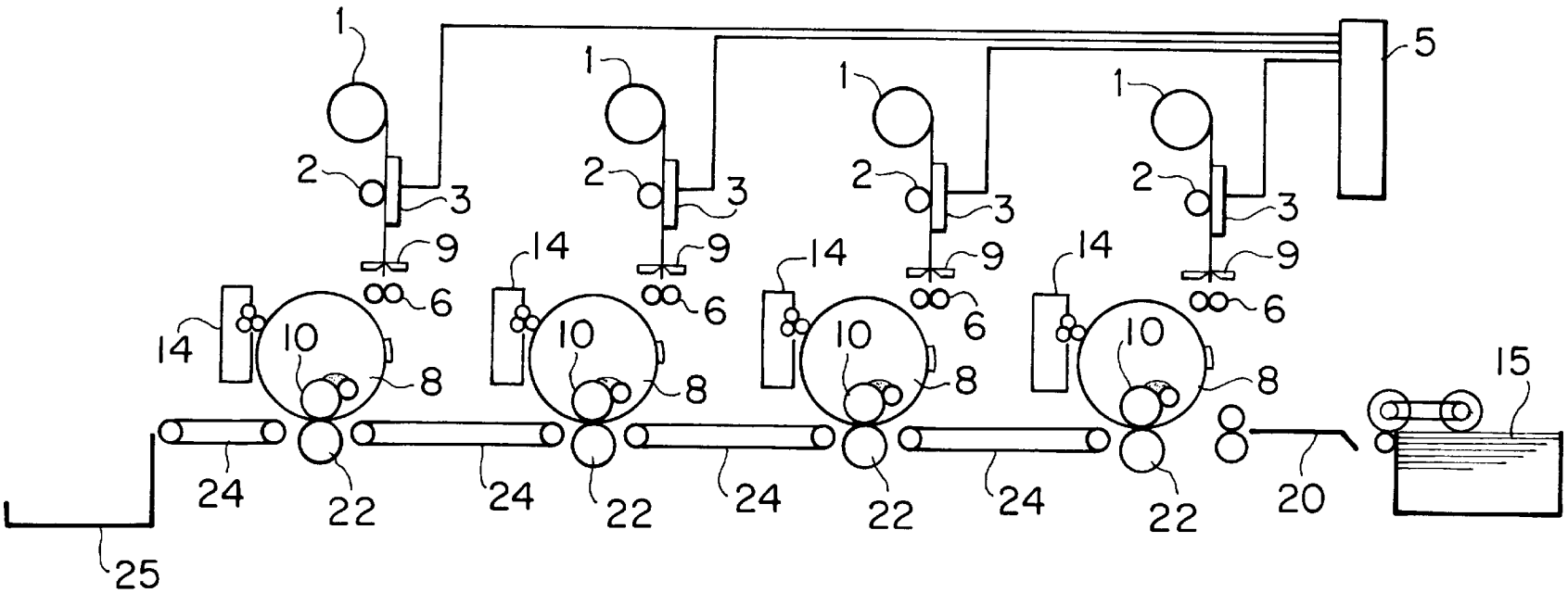
FIG. 8 is a schematic diagram of an example of the multi-color stencil printing apparatus in which multi-color printing masters prepared from the stencil base sheets according to the present invention are incorporated.

FIG. 8 is a schematic diagram of an example of the multi-color stencil printing apparatus in which multi-color printing masters prepared from the stencil base sheets according to the present invention are incorporated.

Figure 9:
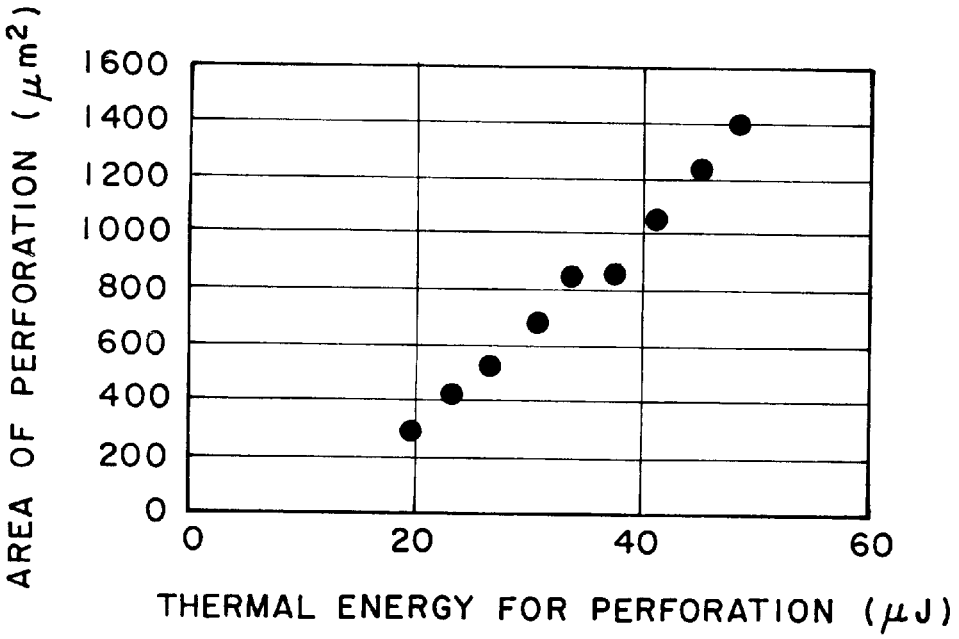
FIG. 9 is a graph which shows the relationship between the thermal energy for perforation and the average area of a perforation.

In FIG. 9, each printing master for cyan, yellow, magenta or black color is prepared from each stencil base paper 1, and the respective printing master is wound around the respective printing cylinder B. The printing cylinders 8 for cyan, yellow, magenta and black are disposed in a row. The same reference numerals as in FIG. 7 indicate the same components as in FIG. 7.

Figure 11:
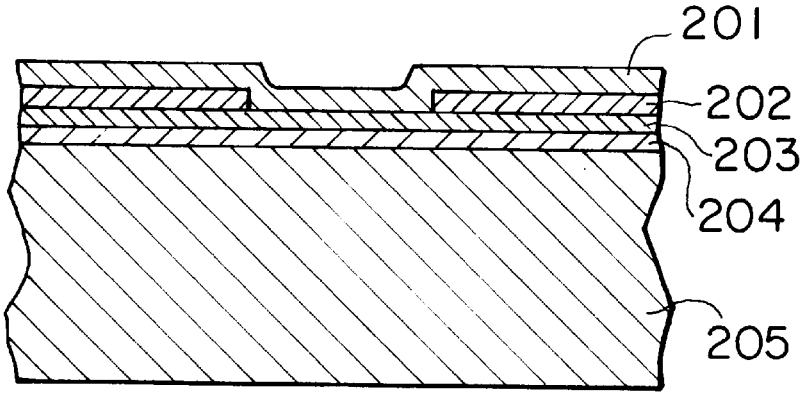
FIG. 11 is a schematic cross-sectional view of an entirely-glazed thermal head.
Figure 12:
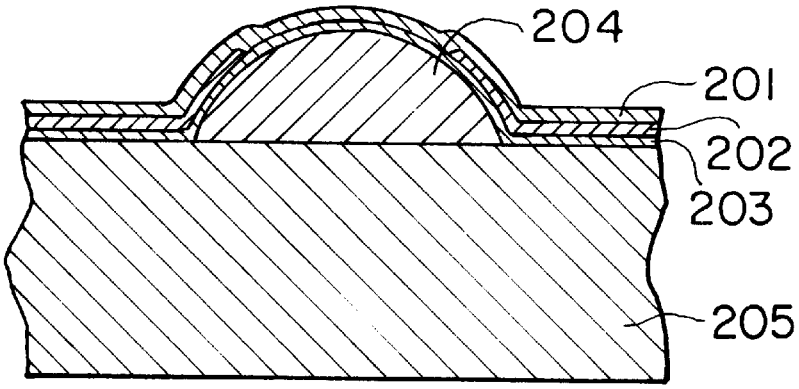
FIG. 12 is a schematic cross-sectional view of a partially-glazed thermal head.
Figure 13:
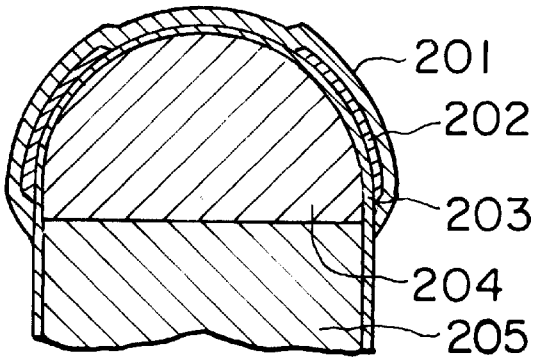
FIG. 13 is a schematic cross-sectional view of an edge-type thermal head.

As the heat-emitting resistor element for use in the present invention, there can be employed, for example, an entirely-glazed thermal head, a partially-glazed thermal heads and an edge-type thermal, which are respectively shown in FIGS. 11, 12 and 13, but the heat-emitting resistor element is not limited to these thermal heads.

The entirely-glazed thermal head as shown in FIG. 11 comprises an insulating substrate 205, a glazed layer 204, a high-resistance heat-emitting layer 203, an electrode 202 and a protective layer 201, which are successively overlaid on the insulating substrate 205.

In the entirely-glazed thermal head shown in FIG. 11, the glazed layer 204, which has a heat-insulating effect, is thinly overlaid on the entire surface of the insulating substrate 205 for improvement of heat accumulation.

In contrast to this, in the partially-glazed thermal head as shown in FIG. 12, the glazed layer 204 is overlaid in the form of a thick layer on part of the insulating substrate 205 as shown in FIG. 12.

In the edge-type thermal head as shown in FIG. 13, the entirely-glazed thermal head is provided on a curved edge portion of the insulating substrate 205.

In the present invention, the partially-glazed thermal head (&a shown in FIG. 12) and the edge-type thermal head (as shown in FIG. 13), each having a convex top, are preferably employed because the heat-emitting resistor element thereof can be brought into closer contact with the stencil base sheet.

In order to obtain images with sufficiently high resolution in a printed matter, it is preferable that the heat-emitting resistor element comprise heating elements with a density of at least 200 dpi, and more preferably at least 400 dpi.

In the method of producing the printing master from the stencil base sheet of the present invention, high close contact of the heat-emitting resistor element with the stencil base sheet is attained, so that the thermal conductivity between the heat-emitting resistor element and the stencil base sheet is high and accordingly the perforation sensitivity of the stencil base sheet is also high. Therefore, the amount of the perforation energy required by one element of the heat-emitting resistor element is smaller than the amount of the perforation energy required by one element of a conventional heat-emitting resistor element.

It is preferable that the perforation energy required by one element of the heat-emitting resistor element be 5 $\mu$J or more to prevent the failure of perforation, and 500 $\mu$J or less to prevent the adhesion of the melted stencil base sheet to the thermal head.

The image obtained by the stencil printing method of the present invention can be evaluated, using images based on SCID (Standard Color Image Data) (hereinafter referred to as SCID images), a resolving power chart or a gray scale.

The SCID images are standard digital color images composed of 400 dpi×8 bit, specified for image evaluation by the Japanese Standards Association.

When printing SCID images by the stencil printing method using the printing master prepared by the heat-emitting element, it is preferable to use the error diffusion process such as the dither method to reduce the gradations of the brightness or density of each pixel.

Other features of this invention will become apparent in the course of the following description of exemplary embodiments which are given for illustration of the invention and are not intended to be limiting thereof.

PREPARATION EXAMPLE 1

[Preparation of stencil base sheet No. 1]

(Formulation for porous resin film)

| | Parts by Weight |
|---|---|
| Polyvinyl butyral | 4.0 |
| Ethyl alcohol | 35.5 |
| Water | 11.5 |
| Needle-like magnesium silicate (Trademark "Aid-plus SP", made by Mizusawa Industrial Chemicals, Ltd.) | 0.8 |

The above-mentioned polyvinyl butyral resin was dissolved in a mixture of ethyl alcohol and water to prepare a solution. With the addition of the needle-like magnesium silicate to the above-mentioned solution, the obtained mixture was dispersed in a ball mill. The mixture was then subjected to filtration, so that a coating liquid for a porous resin film was prepared.

The above prepared coating liquid was uniformly coated by a wire bar on a biaxially oriented polyester film with a thickness of 3.5 $\mu$m, and dried by the application of hot air of 50° C. for 3 minutes. Thus, the biaxially oriented polyester film was backed with a porous resin film serving as the porous support.

The deposition amount of the porous resin film was 8.0 g/m$^2$ on a dry basis. On the polyester film, opposite to the porous resin film side, there was provided a sticking-preventing layer in order to prevent the resin film, when thermally fused, from sticking to the thermal head and also to prevent the resin film from being electrostatically charged. To be more specific, a mixture of a silicone resin and a cationic antistatic agent was coated on the polyester film so that the deposition amount might be about 0.05 g/m$^2$ on a dry basis.

Thus, a stencil base sheet No. 1 according to the present invention was prepared.

The surface smoothness of the polyester film side of the stencil base sheet No. 1 was about 15,000 seconds.

PREPARATION EXAMPLE 2

[Preparation of stencil base sheet No. 2]

(Formulation for porous resin film)

| | Parts by Weight |
|---|---|
| Polyvinyl butyral | 4.0 |
| Ethyl alcohol | 35.5 |
| Water | 11.5 |
| Needle-like magnesium silicate (Trademark "Aid-plus SP", made by Mizusawa Industrial Chemicals, Ltd.) | 0.8 |

The above-mentioned polyvinyl butyral resin was dissolved in a mixture of ethyl alcohol and water to prepare a solution. With the addition of the needle-like magnesium silicate to the above-mentioned solution, the obtained mixture was dispersed in a ball mill. The mixture was subjected to filtration, so that a coating liquid for a porous resin film was prepared.

The above prepared coating liquid was uniformly coated by a wire bar on a biaxially oriented polyethylene terephthalate film with a thickness of 2.0 $\mu$m, and dried by the application of hot air of 50° C. for 3 minutes. Thus, the polyethylene terephthalate film was backed with a porous resin film serving as the porous support.

The deposition amount of the porous resin film was 8.2 g/m$^2$ on a dry basis. On the polyethylene terephthalate film, opposite to the porous resin film side, there was provided a sticking-preventing layer in order to prevent the resin film, when thermally fused, from sticking to the thermal head and also to prevent the resin film from being electrostatically charged. To be more specific, a mixture of a silicone resin and a cationic antistatic agent was coated on the polyethylene terephthalate film so that the deposition amount might be about 0.05 g/m$^2$ on a dry basis.

Thus, a stencil base sheet No. 2 according to the present invention was prepared.

The surface smoothness of the polyethylene terephthalate film side of the stencil base sheet No 2 was about 6,000 seconds.

PREPARATION EXAMPLE 3

[Preparation of stencil base sheet No. 3]

The procedure for preparation of the stencil base sheet No. 2 according to the present invention in Preparation Example 2 was repeated except that the deposition amount of the porous resin film on the polyethylene terephthalate film was changed from 8.2 to 7.0 g/m$^2$ on a dry basis.

Thus, a stencil base sheet No. 3 according to the present invention was prepared.

The surface smoothness of the polyethylene terephthalate film side of the stencil base sheet No. 3 was about 8,000 seconds.

PREPARATION EXAMPLE 4

[Preparation of stencil base sheet No. 4]

The procedure for preparation of the stencil base sheet No. 2 according to the present invention in Preparation Example 2 was repeated except that the deposition amount of the porous resin film on the polyethylene terephthalate film was changed from 8.2 to 6.7 g/m$^2$ on a dry basis.

Thus, a stencil base sheet No. 4 according to the present invention was prepared.

The surface smoothness of the polyethylene terephthalate film side of the stencil base sheet No. 4 was about 12,000 seconds.

PREPARATION EXAMPLE 5

[Preparation of stencil base sheet No. 5]

The procedure for preparation of the stencil base sheet No. 2 according to the present invention in Preparation Example 2 was repeated except that the deposition amount of the porous resin film on the polyethylene terephthalate film was changed from 8.2 to 6.4 g/m$^2$ on a dry basis.

Thug, a stencil base sheet No. 5 according to the present invention was prepared.

The surface smoothness of the polyethylene terephthalate film side of the stencil base sheet No. 5 was about 20,000 seconds.

COMPARATIVE PREPARATION EXAMPLE 1

[Preparation of comparative stencil base sheet No. 1]

An adhesive of a vinyl chloride—vinyl acetate emulsion was coated on a biaxially oriented polyester film with a thickness of 2.0 $\mu$m by a wire bar so that the deposition amount of the adhesive might be 0.42 g/m$^2$ on a dry basis.

A Japanese paper with a basis weight of 12.5 g/m$^2$ and a thickness of 48 $\mu$m consisting of Manila hemp, serving as the porous support, was applied to the adhesive-coated surface of the polyester film, followed by calendering at a linear pressure of 20.0 kg/cm. Then, the laminated material thus obtained was dried at 50° C. for 2 minutes.

Thus, a comparative stencil base sheet No. 1 was prepared.

The surface smoothness of the polyester film of the comparative stencil base sheet No. 1 was about 4,000 seconds.

Table 1 shows the deposition amount of the porous resin film on a dry basis and the surface smoothness of the thermoplastic resin film side of each stencil base sheet.

TABLE 1

| | Deposition Amount of Porous Resin Film (g/cm$^2$) | Surface Smoothness of Thermoplastic Resin Film Side (sec.) |
|---|---|---|
| Prep. Ex. 1 | 8.0 | 15,000 |
| Prep. Ex. 2 | 8.2 | 6,000 |
| Prep. Ex. 3 | 7.0 | 8,000 |
| Prep. Ex. 4 | 6.7 | 12,000 |
| Prep. Ex. 5 | 6.4 | 20,000 |
| Comp. Prep. Ex. 1 | — | 4,000 |

PREPARATION EXAMPLE OF STENCIL INK (1) Cyan ink

[Preparation of Oil Phase]

A mixture of the following components was dispersed in a three-roll mill, thereby obtaining a primary dispersion:

| | Parts by weight |
|---|---|
| Phthalocyanine blue (coloring agent) | 6.0 |
| Emulsifying agent (Trademark "Ionet S85", made by Sanyo Chemical Industries, Ltd.) HLB: 1.8 | 8.0 |
| Dispersant (Trademark "Plenact Al-M", made by Ajinomoto Co., Inc.) | 0.4 |
| Spindle oil (high-boiling oil) | 66.0 |

With the addition of 60.0 parts by weight of spindle oil to the above primary dispersion, the mixture thus obtained was stirred, so that an oil phase was prepared.

[Preparation of Water Phase]

Formulation for water phase

| | Parts by Weight |
|---|---|
| Water | 102 |
| Methyl para-hydroxybenzoate (antifungal agent) | 0.1 |
| Polyacrylic acid | 0.67 |
| Triethanolamine | 0.67 |
| Ethylene glycol | 16.67 |

The above-mentioned methyl para-hydroxybenzoate was dissolved in water. To the above prepared solution, polyacrylic acid and triethanolamine were successively added with stirring, so that gelation of the mixture took place. With the addition of ethylene glycol to the above-mentioned mixture, a water phase was prepared.

The above prepared water phase was gradually added to the oil phase with stirring, so that a cyan stencil ink of an emulsion type was prepared.

(2) Magenta ink

The procedure for preparation of the cyan stencil ink was repeated except that the phthalocyanine blue for use in the oil phase formulation for the cyan stencil ink was replaced by a commercially available magenta pigment "PPE-02" (Trademark), made by Hoechst Japan Limited.

Thus, a magenta stencil ink of an emulsion type was prepared.

(3) Yellow ink

The procedure for preparation of the cyan stencil ink was repeated except that the phthalacyanine blue for use in the oil phase formulation for the cyan stencil ink was replaced by a commercially available yellow pigment "DIC Yellow 4221", (Trademark), made by Dainippon Ink & Chemicals, Incorporated.

Thus, a yellow stencil ink of an emulsion type was prepared.

(4) Black ink

The procedure for preparation of the cyan stencil ink was repeated except that the phthalocyanine blue for use in the oil phase formulation for the cyan stencil ink was replaced by a commercially available carbon black.

Thus, a black stencil ink of an emulsion type was prepared.

EXAMPLE 1

Using an apparatus of producing a printing master as shown in FIG. 3, perforations were formed in the stencil base sheet No. 1 according to the present invention obtained in Preparation Example 1 in such a manner that the pulse width was modulated into 10 values corresponding to the image density of a 25% halftone image (400 dpi) by the pulse modulation control unit, and the thus obtained electric signals were applied to the thermal head. The thermal head for use in the apparatus was a commercially available entirely-glazed thermal head made by Toshiba Corporation, with an output of 0.09 W and a dot density of 400 dpi.

Then, the printing master thus perforated in the stencil base sheet No. 1 was set in a commercially available "PRIPORT VT-3820" (Trademark) stencil printing apparatus made by Ricoh Company, Ltd., which was supplied with a commercially available "VT-500 BLACK" (Trademark) stencil ink made by Ricoh Company, Ltd. The stencil printing was carried out on a commercially available "PPC TYPE 6200" (Trademark) paper made by Ricoh Company, Ltd.

Table 2 shows the pulse width applied to the thermal head, the obtained thermal energy for perforation, the area of a perforation formed in the stencil base sheet, and the area of a dot printed on the paper.

In this case, the perforations of the number of 100 and the dots of the number of 100 were sampled for each pulse width, and the average area was measured using a commercially available "LA-525" (Trademark) measuring instrument made by PIAS Corporation.

TABLE 2

| Pulse Width | Perforation Thermal | Average Area ($\mu m^2$) | |
|---|---|---|---|
| ($\mu$sec) | Energy ($\mu$J) | Perforation | Dot |
| 499 | 48.29 | 1402 | 5814 |
| 464 | 44.91 | 1253 | 4574 |
| 424 | 41.05 | 1059 | 4119 |
| 389 | 37.67 | 849 | 3937 |
| 349 | 33.8 | 839 | 3716 |
| 314 | 30.42 | 687 | 3421 |
| 274 | 26.56 | 536 | 2999 |
| 240 | 23.18 | 428 | 2824 |
| 200 | 19.32 | 301 | 2288 |

FIG. 9 is a graph showing the relationship between the thermal energy applied to the stencil base sheet for perforation and the area of a perforation formed in the stencil base sheet.

Figure 10:
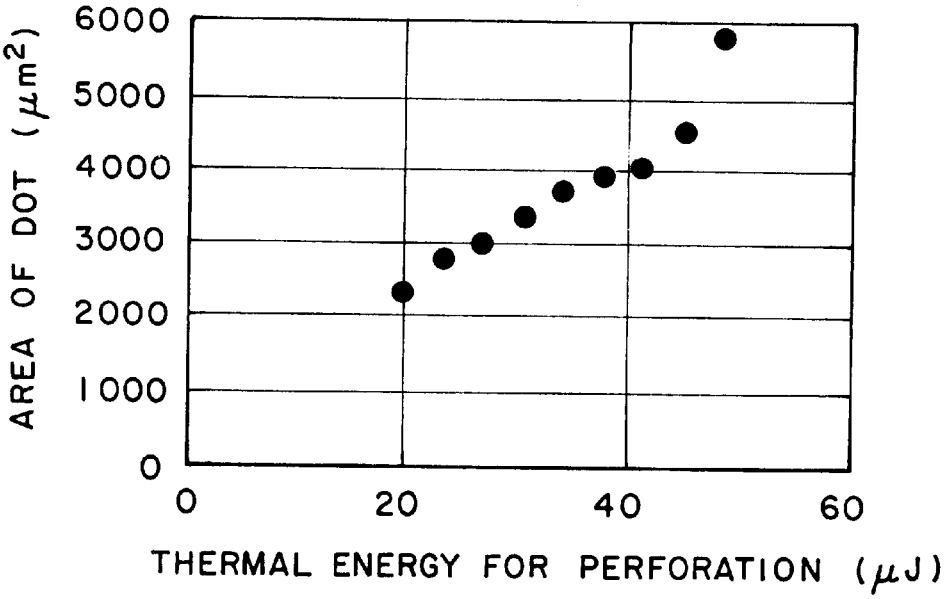
FIG. 10 is a graph which shows the relationship between the thermal energy for perforation and the average area of a dot.

FIG. 10 is a graph showing the relationship between the thermal energy applied to the stencil base sheet for perforation and the area of a dot printed on paper.

As can be seen from the results shown in Table 2, FIG. 9 and FIG. 10, the area of a perforation formed in the stencil base sheet and the area of a dot printed on the paper vary depending on the thermal energy applied to the thermal head, that is, the applied pulse width, for forming a perforation. It is confirmed that there is the correlation between the thermal energy for perforation and the area of a perforation or the area of a dot. Thus, it is possible to change the perforation area and the dot area by multiple systems.

EXAMPLE 2

Using an apparatus as shown in FIG. 7 which was obtained by modifying a commercially available "PRIPORT VT-3820" (Trademark) stencil printing apparatus, perforations were formed in a commercially available stencil base sheet, namely, a biaxially oriented polyethylene terephthalate film with a thickness of 1.5 $\mu$m, made by Teijin Limited. The perforation was formed in such a manner that the pulse modulation was carried out by 4-valued pulse width modulation corresponding to the image density of three kinds of images, to be more specific, an SCUD N5 image, a resolving power chart, a halftone image (0 to 100%), each of which had been subjected to treatment by error diffusion process. The thermal head for use in the apparatus was a commercially available entirely glazed thermal head made by Toshiba Corporation, with an output of 0.09 W and a dot density of 400 dpi.

Further, using a commercially available "VT-500 BLACK" (Trademark) stencil ink, made by Ricoh Company, Ltd., the stencil printing was performed on a commercially available "PPC TYPE 6200" (Trademark) paper, made by Ricoh Company, Ltd.

Table 3 shows the pulse width applied to the thermal head and the obtained thermal energy for perforation.

TABLE 3

| Pulse Width ($\mu$sec) | Thermal Energy for Perforation ($\mu$J) |
|---|---|
| 499 | 48.29 |
| 389 | 37.67 |
| 150 | 14.49 |
| 0 | 0.00 |

As a result, the images printed on the paper were excellent in terms of the gradation and resolution.

According to the measurement of resolving power, a chart image with a line width of 0.1 mm and a space of 0.1 mm was reproduced.

A 10% halftone image according to the gray scale was reproduced without graininess.

In addition, when stencil printing was continuously performed on 10 sheets of PPC paper using the same images, it was confirmed that there was no ink deposition on the back side of paper due to the offset phenomenon.

EXAMPLE 3

The procedure for preparation of the printing master for stencil printing in Example 2 was repeated except that the commercially available biaxially oriented polyethylene terephthalate film as employed in Example 2 was replaced by the stencil base sheet No. 1 prepared in Preparation Example 1. Then, the stencil printing was performed using the thus obtained printing master in the same manner as in Example 2.

As a result, the images printed on the paper were excellent in terms of the gradation and resolution.

According to the measurement of resolving power, a chart image with a line width of 0.1 mm and a space of 0.1 mm was reproduced.

Further, since the stencil base sheet No. 1 was constructed in such a manner that the polyester film was backed with the porous resin film, the printing master obtained from the above-mentioned stencil base sheet No. 1 was steadily wound around a printing cylinder without becoming creased when the stencil printing was performed.

In addition, multi-color stencil printing was using an apparatus as shown in FIG. 8 under the same conditions as mentioned above except that the commercially available "VT-500 CYAN" (Trademark), "VT-500 MAGENTA" (Trademark), and "VT-500 YELLOW" (Trademark) stencil inks were added to the "VT-500 BLACK" (Trademark) stencil ink.

As a result, full-color images with excellent gradation and resolution were obtained.

EXAMPLE 4

The procedure for preparation of the printing master for stencil printing in Example 2 was repeated except that the commercially available biaxially oriented polyethylene terephthalate film as employed in Example 2 was replaced by the stencil base sheet No. 2 prepared in Preparation Example 2. Then, the stencil printing was performed using the thus obtained printing master in the same manner as in Example 2.

As a result, the images printed on the paper were excellent in terms of the gradation and resolution.

According to the measurement of resolving power, a chart image with a line width of 0.1 mm and a space of 0.1 mm was reproduced.

A 10% halftone image according to the gray scale was reproduced without graininess.

In addition, when stencil printing was continuously performed on 10 sheets of PPC (Trademark) paper using the same images, it was confirmed that there was no ink deposition on the back side of paper due to the offset phenomenon.

EXAMPLE 5

The procedure for preparation of the printing master for stencil printing in Example 2 was repeated except that the commercially available biaxially oriented polyethylene terephthalate film as employed in Example 2 was replaced by the stencil base sheet No. 3 prepared in Preparation Example 3. Then, the stencil printing was performed using the thus obtained printing master in the same manner as in Example 2.

As a result, the images printed on the paper were excellent in terms of the gradation and resolution.

According to the measurement of resolving power, a chart image with a line width of 0.1 mm and a space of 0.1 mm was reproduced.

A 10% halftone image according to the gray scale was reproduced without graininess.

In addition, then stencil printing was continuously performed on 10 sheets of PPC (Trademark) paper using the same images, it was confirmed that there was no ink deposition on the back side of paper due to the offset phenomenon.

EXAMPLE 6

The procedure for preparation of the printing master for stencil printing in Example 2 was repeated except that the commercially available biaxially oriented polyethylene terephthalate film as employed in Example 2 was replaced by the stencil base sheet No. 4 prepared in Preparation Example 4. Then, the stencil printing was performed using the thus obtained printing master in the same manner as in Example 2.

As a result, the images printed on the paper were excellent in terms of the gradation and resolution.

According to the measurement of resolving power, a chart image with a line width of 0.1 mm and a space of 0.1 mm was reproduced.

A 10% halftone image according to the gray scale was reproduced without graininess.

In addition, when stencil printing was continuously performed on 10 sheets of PPC (Trademark) paper using the same images, it was confirmed that there was no ink deposition on the back side of paper due to the offset phenomenon.

EXAMPLE 7

The procedure for preparation of the printing master for stencil printing in Example 2 was repeated except that the commercially available biaxially oriented polyethylene terephthalate film as employed in Example 2 was replaced by the stencil base sheet No. 5 prepared in Preparation Example 5. Then, the stencil printing was performed using the thus obtained printing master in the same manner as in Example 2.

As a result, the images printed on the paper were excellent in terms of the gradation and resolution.

According to the measurement of resolving power, a chart image with a line width of 0.1 mm and a space of 0.1 mm was reproduced.

A 10% halftone image according to the gray scale was reproduced without graininess.

In addition, when stencil printing was continuously performed on 10 sheets of PPC (Trademark) paper using the same images, it was confirmed that there was no ink deposition on the back side of paper due to the offset phenomenon.

EXAMPLE 8

The procedure for preparation of the printing master for stencil printing in Example 4 was repeated except that the entirely-glazed thermal head with a dot density of 400 dpi for use in the apparatus in Example 4 was replaced by a entirely-glazed thermal head with a dot density of 600 dpi. Then, the stencil printing was performed using the thus obtained printing master in the same manner as in Example 4.

As a result, the images printed on the paper were excellent in terms of the gradation and resolution.

According to the measurement of resolving power, a chart image with a line width of 0.1 mm and a space of 0.1 mm was reproduced.

A 10% halftone image according to the gray scale was reproduced without graininess.

In addition, when stencil printing was continuously performed on 10 sheets of PPC (Trademark) paper using the same images, it was confirmed that there was no ink deposition on the back side of paper due to the offset phenomenon.

EXAMPLE 9

The procedure for preparation of the printing master for stencil printing in Example 4 was repeated except that the entirely-glazed thermal head with a dot density of 400 dpi for use in the apparatus in Example 4 was replaced by a partially-glazed thermal head with a dot density of 400 dpi. Then, the stencil printing was performed using the thus obtained printing master in the same manner as in Example 4.

As a result, the images printed on the paper were excellent in terms of the gradation and resolution.

According to the measurement of resolving power, a chart image with a line width of 0.1 mm and a space of 0.1 mm was reproduced.

A 10% halftone image according to the gray scale was reproduced without graininess.

In addition, when stencil printing was continuously performed on 10 sheets of PPC (Trademark) paper using the same images, it was confirmed that there was no ink deposition on the back side of paper due to the offset phenomenon.

EXAMPLE 10

The procedure for preparation of the printing master for stencil printing in Example 4 was repeated except that the entirely-glazed thermal head with a dot density of 400 dpi for use in the apparatus in Example 4 was replaced by an edge-type line thermal head with a dot density of 300 dpi. Then, the stencil printing was performed using the thus obtained printing master in the same manner as in Example 4.

As a result, the images printed on the paper were excellent in terms of the gradation and resolution.

According to the measurement of resolving power, a chart image with a line width of 0.1 mm and a space of 0.1 mm was reproduced.

A 10% halftone image according to the gray scale was reproduced without graininess.

In addition, when stencil printing was continuously performed on 10 sheets of PPC (Trademark) paper using the same images, it was confirmed that there was no ink deposition on the back side of paper due to the offset phenomenon.

COMPARATIVE EXAMPLE 1

The procedure for preparation of the printing master for stencil printing in Example 3 was repeated except that the pulse modulation was carried out by 2-valued pulse width modulation as shown in Table 4. Then, the stencil printing was performed using the thus obtained printing master in the same manner as in Example 3.

TABLE 4

| Pulse Width (μsec) | Thermal Energy for Perforation (μJ) |
|---|---|
| 499 | 48.29 |
| 0 | 0.00 |

As a result, the resolution of the images printed on the paper was poor.

According to the measurement of resolving power, a chart image with a line width of 0.2 mm and a space of 0.2 mm was not reproduced.

Because of the graininess, a 10% halftone image according to the gray scale was unsatisfactory.

In addition, when stencil printing was continuously performed on 10 sheets of PPC (Trademark) paper using the same images, it was confirmed that there was ink deposition on the back side of paper due to the offset phenomenon.

COMPARATIVE EXAMPLE 2

The procedure for preparation of the printing master for stencil printing in Example 2 was repeated except that the commercially available biaxially oriented polyethylene terephthelate film as employed in Example 2 was replaced by a commercially available "VT-A3II" (Trademark), stencil base sheet made by Ricoh Company, Ltd.

The above-mentioned "VT-A311" (Trademark) stencil base sheet was designed for the "PRIPORT" (Trademark) printing apparatus made by Ricoh Company, Ltd., was prepared by attaching a thermoplastic resin film to a Japanese Paper roughly made from natural fiber. The surface smoothness of the thermoplastic resin film side was 2,000 sec.

Then, the stencil printing was performed using the thus obtained printing master in the same manner as in Example 2.

According to the measurement of resolving power, a chart image with a line width of 0.1 mm and a space of 0.1 mm was not reproduced although a chart image with a line width of 0.2 mm and a space of 0.2 mm was reproduced.

Because of the graininess, a 10% halftone image according to the gray scale was unsatisfactory, In addition, when stencil printing was continuously performed on 10 sheets of PPC (Trademark) paper using the same images, it was confirmed that there was in deposition on the back side of paper due to the offset phenomenon.

COMPARATIVE EXAMPLE 3

The procedure for preparation of the printing master for stencil printing in Example 2 was repeated except that the commercially available biaxially oriented polyethylene terephthalate film as employed in Example 2 was replaced by the comparative stencil base sheet No. 1 prepared in Comparative Preparation Example 1. Then, the stencil printing was performed using the thus obtained printing master in the same manner as in Example 2.

According to the measurement of resolving power, a chart image with a line width of 0.1 mm and a space of 0.1 mm was not reproduced although a chart image with a line width of 0.2 mm and a space of 0.2 mm was reproduced.

Due to the graininess, a 10% halftone image according to the gray scale was unsatisfactory.

In addition, when stencil printing was continuously performed on 10 sheets of PPC (Trademark) paper using the same images, it was confirmed that there was ink deposition on the back side of paper due to the offset phenomenon.

TABLE 5

| | Stencil Base Sheet | Surface Smoothness (sec.) | System of PWM | Thermal Head |
|---|---|---|---|---|
| Ex. 1 | No. 1 (Preparation Example 1) | 15,000 | 10 | Entirely-glazed type 400 dpi |
| Ex. 2 | Biaxially oriented PET film | 10,000 | 4 | Entirely-glazed type 400 dpi |
| Ex. 3 | No. 1 (Preparation Example 1) | 15,000 | 4 | Entirely-glazed type 400 dpi |
| Ex. 4 | No. 2 (Preparation Example 2) | 6,000 | 4 | Entirely-glazed type 400 dpi |
| Ex. 5 | No. 3 (Preparation Example 3) | 8,000 | 4 | Entirely-glazed type 400 dpi |
| Ex. 6 | No. 4 (Preparation Example 4) | 12,000 | 4 | Entirely-glazed type 400 dpi |
| Ex. 7 | No. 5 (Preparation Example 5) | 20,000 | 4 | Entirely-glazed type 400 dpi |
| Ex. 8 | No. 2 (Preparation Example 2) | 6,000 | 4 | Entirely-glazed type 600 dpi |

TABLE 5-continued

| | Stencil Base Sheet | Surface Smoothness (sec.) | System of PWM | Thermal Head |
|---|---|---|---|---|
| Ex. 9 | No. 2 (Preparation Example 2) | 6,000 | 4 | Partially-glazed type 400 dpi |
| Ex. 10 | No. 2 (Preparation Example 2) | 6,000 | 4 | Edge-type 300 dpi |
| Comp. Ex. 1 | No. 1 (Preparation Example 1) | 15,000 | 2 | Entirely-glazed type 400 dpi |
| Comp. Ex. 2 | "VT-A3II" | 2,000 | 4 | Entirely-glazed type 400 dpi |
| Comp. Ex. 3 | Comparative No. 1(Comp. Pre. Ex. 1) | 4,000 | 4 | Entirely-glazed type 400 dpi |

TABLE 6

| | | Resolution(**) | | |
|---|---|---|---|---|
| | Graininess (*) | Line & Space of 0.2 mm | Line & Space of 0.1 mm | Offset |
| Ex. 1 | ⊙ | ○ | ○ | None |
| Ex. 2 | ⊙ | ○ | ○ | None |
| Ex. 3 | ⊙ | ○ | ○ | None |
| Ex. 4 | ○ | ○ | ○ | None |
| Ex. 5 | ⊙ | ○ | ○ | None |
| Ex. 6 | ⊙ | ○ | ○ | None |
| Ex. 7 | ⊙ | ○ | ○ | None |
| Ex. 8 | ⊙ | ○ | ○ | None |
| Ex. 9 | ⊙ | ○ | ○ | None |
| Ex. 10 | ⊙ | ○ | ○ | None |
| Comp Ex. 1 | x | x | x | Observed |
| Comp. Ex. 2 | x | ○ | x | Observed |
| Comp. Ex. 3 | x | ○ | x | Observed |

(*)Graininess
⊙: There was no graininess.
○: The graininess was very slight.
x: The graininess was noticeable.
(**)Resolution
○: Excellent
x: Poor Japanese Patent Application No. 8-162312 filed Jun. 3, 1996 in hereby incorporated by reference.

What is claimed is:

1. A stencil base sheet comprising a thermoplastic resin film, with a surface of said stencil base sheet on the side of said thermoplastic resin film having a surface smoothness of at least 6000 seconds, for preparing a printing master by use of a heat-emitting resistor element with the application of electric signals thereto with pulse modulation corresponding to a recording image density to be obtained, thereby forming perforations of a different size in said stencil base sheet by thermal fusing, corresponding to said recording image density.

2. The stencil base sheet as claimed in claim 1, wherein said thermoplastic resin film is a biaxially oriented film.

3. The stencil base sheet as claimed in claim 1, further comprising a porous support with which said thermoplastic resin film in backed.

4. The stencil base sheet as claimed in claim 3, wherein said porous support is a porous resin film.

5. A method of producing a printing master from a stencil base sheet comprising a thermoplastic resin film, with a surface of said stencil base sheet on the side of said thermoplastic resin film having a surface smoothness of at least 6000 seconds, comprising the step of forming perforations of a different size in said stencil base sheet by thermal fusing, corresponding to a recording image density to be obtained, by use of a heat-emitting resistor element with the application of electric signals thereto with pulse modulation corresponding to said recording image density.

6. The method as claimed in claim 5, wherein said thermoplastic resin film is a biaxially oriented film.

7. The method as claimed in claim 5, wherein said stencil base sheet further comprises a porous support with which said thermoplastic resin film is backed.

8. The method as claimed in claim 7, wherein said porous support is a porous resin film.

9. The method as claimed in claim 5, wherein said heat-emitting resistor comprises a plurality of heating elements with a density of at least 400 dpi.

10. The method as claimed in claim 5, wherein said heat-emitting resistor is a partially-glazed thin-film layer type thermal head.

11. The method as claimed in claim 5, wherein said heat-emitting resistor is an edge-type line thermal head.

12. A method of performing stencil printing, using a stencil base sheet comprising a thermoplastic resin film, with a surface of said stencil base sheet on the side of said thermoplastic resin film having a smoothness of at least 6000 seconds, comprising the steps of:

forming perforation images comprising perforations of a different size in said stencil base sheet by thermal fusing, corresponding to a recording image density to be obtained, by use of a heat-emitting resistor element with the application of electric signals thereto with pulse modulation corresponding to said recording image density, thereby preparing a printing master with said perforation images, winding said printing master around an outer surface of a printing cylinder supplying an ink from an inner surface thereof to said printing master, bringing an image receiving sheet into pressure contact with said printing master, and transferring said ink perforation-imagewise to said image receiving sheet to form perforation images thereon.

13. A method of performing multi-color stencil printing, using a stencil base sheet comprising a thermoplastic film, with a surface of said stencil base sheet on the side of said thermoplastic film having a smoothness of at least 6000 seconds for each color, comprising the steps of:

forming perforation images comprising perforations of a different size in said stencil base sheet by thermal fusing, corresponding to a recording image density to be obtained, by use of a heat-emitting resistor with the application of electric signals thereto with pulse modulation corresponding to said recording image density, thereby preparing a color printing master for each color with said perforation images, winding each of said color printing masters around an outer surface of a different color printing cylinder supplying a color ink from an inner surface thereof to each of said printing masters, bringing an image receiving sheet into pressure contact with each of said color printing masters successively, and transferring each of said inks perforation-imagewise to said image receiving sheet successively to form multi-color perforation images thereon.

14. The method as claimed in claim 13, wherein there are provided four color printing cylinders, each using one of cyan, yellow, magenta and black inks as said color ink.

* * * * *